US009548175B2

(12) United States Patent
Duwe et al.

(10) Patent No.: US 9,548,175 B2
(45) Date of Patent: Jan. 17, 2017

(54) SWITCHING-DEVICE TRIPPING APPARATUS

(71) Applicant: SIEMENS AKTIENGELLSCHAFT, Munich (DE)

(72) Inventors: Oliver Duwe, Brandenburg an der Havel (DE); Thomas Hilker, Stahnsdorf (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/362,175

(22) PCT Filed: Nov. 15, 2012

(86) PCT No.: PCT/EP2012/072686

§ 371 (c)(1),
(2) Date: Jun. 2, 2014

(87) PCT Pub. No.: WO2013/079329

PCT Pub. Date: Jun. 6, 2013

(65) Prior Publication Data

US 2014/0292452 A1 Oct. 2, 2014

(30) Foreign Application Priority Data

Dec. 2, 2011 (DE) ..... 10 2011 087 651

(51) Int. Cl.

| | |
|---|---|
| ***H01H 71/24*** | (2006.01) |
| ***H01H 71/28*** | (2006.01) |
| *H01H 71/34* | (2006.01) |
| *H01H 3/30* | (2006.01) |
| *H01H 9/56* | (2006.01) |
| *H01H 9/00* | (2006.01) |

(52) U.S. Cl.

CPC ..... *H01H 71/24* (2013.01); *H01H 71/2463* (2013.01); *H01H 71/28* (2013.01); *H01H 3/30* (2013.01); *H01H 9/563* (2013.01); *H01H 71/34* (2013.01); *H01H 71/345* (2013.01); *H01H 2009/0083* (2013.01)

(58) Field of Classification Search

CPC .. H01H 71/2463; H01H 71/34; H01H 71/345; H01H 2009/0083

USPC ..... 335/172–184

See application file for complete search history.

(56) References Cited

U.S. PATENT DOCUMENTS

| | | | | |
|---|---|---|---|---|
| 1,506,409 | A * | 8/1924 | Classen | 335/177 |
| 1,530,963 | A * | 3/1925 | Tritle | 335/174 |
| 1,749,602 | A * | 3/1930 | Peterson | 335/170 |

(Continued)

FOREIGN PATENT DOCUMENTS

| | | |
|---|---|---|
| CH | 146694 A | 4/1931 |
| DE | 577791 C | 6/1933 |

(Continued)

*Primary Examiner* — Ramon M Barrera

(74) *Attorney, Agent, or Firm* — Laurence Greenberg; Werner Stemer; Ralph Locher

(57) ABSTRACT

A switching-device tripping apparatus for a switching device includes contact pieces that can be moved relative to one another. Relative motion between the contact pieces is generated by a gear or transmission configuration. The gear or transmission configuration has a pawl in order to control motion of the contact pieces relative to each other. First and second tripping devices are provided, which work or operate the same pawl and drive the same pawl.

12 Claims, 5 Drawing Sheets

(56) References Cited

U.S. PATENT DOCUMENTS

| | | | | | |
|---|---|---|---|---|---|
| 1,801,838 | A * | 4/1931 | Bakken | 335/175 | |
| 3,076,074 | A * | 1/1963 | Landow et al. | 335/127 | |
| 3,566,320 | A * | 2/1971 | Bakes | 335/174 | |
| 4,180,788 | A * | 12/1979 | Barkan | 335/190 | |
| 4,700,161 | A * | 10/1987 | Todaro et al. | 335/172 | |
| 4,931,758 | A * | 6/1990 | Bagalini | 335/174 | |
| 5,006,826 | A * | 4/1991 | Knoben et al. | 335/35 | |
| 5,089,796 | A * | 2/1992 | Glennon | H01H 83/22 | 335/172 |
| 5,543,766 | A * | 8/1996 | Bagalini | 335/177 | |
| 6,348,847 | B1 * | 2/2002 | Nakajima et al. | 335/195 | |
| 6,444,934 | B1 * | 9/2002 | Imura et al. | 200/400 | |
| 6,610,949 | B2 * | 8/2003 | Mori et al. | 200/400 | |
| 7,298,236 | B2 * | 11/2007 | Chen | 335/21 | |
| 2002/0056631 | A1 * | 5/2002 | Ohtsuka et al. | 200/400 | |
| 2010/0164659 | A1 * | 7/2010 | Ohtsuka | H01H 3/30 | 335/174 |

FOREIGN PATENT DOCUMENTS

| | | | |
|---|---|---|---|
| DE | 597524 | C | 5/1934 |
| DE | 652317 | C | 10/1937 |
| DE | 3044327 | A1 | 10/1982 |
| DE | 3823101 | A1 | 1/1990 |
| DE | 4418642 | A1 | 11/1995 |
| DE | 29715900 | U1 | 11/1997 |
| DE | 102007002918 | A1 | 4/2008 |
| EP | 0851450 | A2 | 7/1998 |
| GB | 360057 | A | 11/1931 |
| JP | H09320407 | A | 12/1997 |

* cited by examiner

SWITCHING-DEVICE TRIPPING APPARATUS

BACKGROUND OF THE INVENTION

Field of the Invention

The invention relates to a switching-device tripping apparatus for a switching device comprising contact pieces which are movable relative to one another, having a gear arrangement for generating a relative movement between the contact pieces comprising a pawl and comprising a tripping means, which is movable against the pawl so as to actuate the pawl.

Such a switching-device tripping apparatus is known, for example, from the utility model DE 297 15 900 U1. The switching-device tripping apparatus disclosed therein provides for the use of a gear arrangement for operating a switching device with contact pieces which are movable relative to one another, wherein the gear arrangement has a pawl, and a movable tripping means is used for actuating the pawl. The known switching-device tripping apparatus has, for a switching device comprising a plurality of switching poles, in each case one pawl and one associated tripping means for each switching pole. It is therefore possible to synchronize the tripping means with one another and to trip the plurality of switching poles approximately simultaneously or to set a desired temporal offset for tripping of switching movements at the individual switching poles of the switching device. One disadvantage, however, consists in that the entire switching device fails in the event of a fault in a switching-device tripping apparatus at one of the switching poles. Such failures should be avoided.

BRIEF SUMMARY OF THE INVENTION

Therefore, the object of the present invention consists in specifying a switching-device tripping apparatus which has increased operational reliability.

In accordance with the invention, the object in the case of a switching-device tripping apparatus of the type mentioned at the outset is achieved in that a first tripping means and a second tripping means drive the same pawl.

An electrical switching device is, for example, a circuit breaker which is used to interrupt or produce a current path between two current path sections. As such, a switching device has contact pieces which are movable relative to one another, for example. In order to interrupt or produce a current path, a relative movement between the contact pieces needs to be generated. It is thus possible, for example, for the two contact pieces to move close to one another in order to produce a current path and finally for galvanic contact-making of said contact pieces to take place such that a closed current path is produced. In the reverse case, in the case of opening of a current path, the two contact pieces which are movable relative to one another move away from one another so that, ultimately, galvanic isolation of said contact pieces takes place. Correspondingly, a disconnect is formed in the current path and the current path is interrupted.

The electrical switching device can have one or more poles. A single-pole switching device is designed to switch a single current path. A multipole switching device has a plurality of switching poles. A multipole switching device can be used to switch a plurality of current paths of a polyphase electrical energy transmission grid. Correspondingly, switching movements of the individual switching poles of a multipole switching device take place such that they are matched to one another temporally.

Depending on the configuration of the electrical switching device, switching-on or switching-off of the switching device is associated with comparatively quick relative movements of the contact pieces relative to one another. It should be possible to demand these relative movements within a few milliseconds, if appropriate, in order to implement a switching operation quickly. Generally, therefore, storage devices are used which can be charged during a relatively long period of time. The energy buffer-stored in the storage device can be output within a shorter period of time than is required for charging of the storage device. For example, mechanical stores, such as spring energy stores, for example, which have at least one storage spring which is tensioned for charging and can be relieved of tension suddenly in order to generate a relative movement of the switching contact pieces relative to one another, have proven to be successful.

Storage springs can be used in various forms. For example, helical springs, spiral springs, bar springs, pneumatic springs, etc can be used. For example, tensioning of the storage springs or relieving the tension on the storage springs can be performed by a gear arrangement. The storage spring is part of the gear arrangement, wherein the energy taken from the storage spring during the process of relieving tension is converted into a movement of a movable contact piece or of a plurality of movable contact pieces. In order to enable easy release of a tensioned storage spring, the gear arrangement is furthermore equipped with a pawl, which holds or blocks the storage spring in the tensioned state. A pawl can comprise, for example, a mechanism which enables blocking of a tensioned spring, wherein a small amount of energy is required for releasing the tensioned spring. For example, the pawl can have a multipart mechanism such as, for example, a toggle lever construction, which is initiated by a tripping means. The pawl is movable by a tripping means, wherein, as a result of a movement of the pawl, the tensioned storage spring is released. Correspondingly, release of buffer-stored force can be performed by means of the gear arrangement for generating a relative movement between the contact pieces of the switching device, which release is used for driving at least one of the contact pieces. Preferably, a movement of a tripping means should effect a switch-off movement, i.e. a separation of the contact pieces which are movable relative to one another.

If a first and a second tripping means are now used which are movable against the same pawl or drive the same pawl, it is possible to increase the reliability of the switching-device tripping apparatus. Even in the case of a fault at one of the tripping means, it is possible for the remaining tripping means on its own to effect a movement of the pawl. The two tripping means are in this case designed in such a way that each of the tripping means on its own can apply sufficient energy to move the pawl and as a result release energy buffer-stored in a storage device. The two tripping means should be connected mechanically parallel to one another.

A further advantageous configuration can provide for the tripping means to each be mounted linearly displaceably.

Displaceable mounting of the tripping means makes it possible to choose space-saving constructions in order to position the tripping means within the gear arrangement. As a result of linearly displaceable mounting, an excursion executed in the direction of the displacement axis of the tripping means can be output to the pawl in a simple manner. It is thus possible to actuate the pawl directly and immediately by virtue of the two tripping means and thus to dispense with interposed assemblies of a kinematic chain. As a result, increased operational reliability is achieved. In addition to direct driving of the pawl via the tripping means, indirect driving of the pawl via the tripping means can also be provided. Thus, for example, a movement of a tripping means can be directed over a kinematic chain. Therefore, a direct physical proximity of tripping means and pawl is not absolutely necessary. Levers, plungers, bolts, gearwheels, racks, chain hoists, cable hoists etc. can be used as parts of a kinematic chain, for example.

A further advantageous configuration can provide for the first tripping means to be driven via a first drive device and for the second tripping means to be driven via a second drive device.

The use of a first drive device and of a second drive device for in each case one of the tripping means has the advantage that, independently of the state of one tripping means, the other tripping means can remain operational. For this purpose, the drive devices should develop their force effects independently of one another. Suitable drive devices are, for example, electrodynamic drives, pneumatic drives, hydraulic drives, etc., which are capable of initiating a movement of the tripping means depending on an actuation signal. Electrodynamic drives have proven to be advantageous in this case since, in the case of compact designs, they can exert high actuating forces on the tripping means. Furthermore, actuation of an electrodynamic drive is possible in a comparatively simple manner. The drive devices can in this case be actuated by one and the same control device. However, provision can also be made for control devices operating independently of one another to actuate in each case the first drive device and the second drive device. Advantageously, provision should be made for the actuation of the two drive devices to take place simultaneously, as far as possible. This can be achieved in particular by virtue of the fact that a common control device for the two drive devices is provided, with the result that the same pulses can be used for actuating the first and second drive devices. However, provision can also be made for two control devices operating in accordance with different criteria to be used which operate in accordance with different algorithms, for example, and thus additionally reduce faulty operation of a switching-device tripping apparatus.

Furthermore, provision can advantageously be made for the first and second drive devices to exert a force effect on the respectively associated tripping means independently of one another.

If the two drive devices each independently of one another act on the respective tripping means, it is possible for each of the tripping means to effect a force effect on the pawl independently of the other tripping means. Thus, the pawl of each of the tripping means, independently of the operating state of the respective other tripping means or its associated drive device, can effect a movement of the pawl.

A further advantageous configuration can provide for the second tripping means to be movable against the locking pawl, with the first tripping means interposed.

If the switching-device tripping apparatus is designed in such a way that the second tripping means is movable against the locking pawl, with the first tripping means interposed, a space-saving solution for the switching-device tripping apparatus can be found, for example. The two tripping means are connected mechanically in series with one another. Owing to the fact that the second tripping means is movable against the locking pawl, with the first tripping means interposed, the first tripping means is part of a kinematic chain, which is used for transferring force and movement from the second tripping means onto the pawl. In addition, over the extent of the kinematic chain, a drive force can also be coupled into the kinematic chain via the first drive device. Thus, the force effects of the two tripping means can be superimposed on one another in order to increase the actuating force at the pawl. However, provision can also be made for the second tripping means to assist in overcoming a breakaway torque of the first tripping means. In particular in the case of switching devices which switch relatively infrequently, it may arise that the gear device or the tripping means become stuck in their bearings. For example, greases and oils can solidify, metal parts can corrode and bearings can thereby become sluggish. As a result of the two tripping means being connected mechanically in series, locking of the first tripping means can be overcome by the additional force effect of the second tripping means and the switching-device tripping apparatus can be made ready for operation again.

A further advantageous configuration can provide for movement axes of the first and second tripping means to be aligned parallel, in particular coaxially to one another.

In particular in the case of a linearly movable mounting of the tripping means, the tripping means should be aligned as far as possible parallel, in particular coaxially to one another. A parallel alignment makes it possible for force effects to act in the direction of the movement axes of the two tripping means in the same way on the locking pawl, with the result that mechanically simple locking pawls can be constructed which can firstly apply high retaining forces for a tensioned storage spring and can secondly release the storage spring by virtue of relatively low actuating forces. In particular in the case of a coaxial alignment of the movement axes of the tripping means, activation of the locking pawl via the second tripping means, with the first tripping means interposed, is also possible in a simple manner, for example. By way of example, the tripping means can be substantially in the form of bolts, wherein the bolts are aligned so as to be positioned one behind the other axially, and one bolt can be driven in the axial direction against the other bolt.

Furthermore, provision can advantageously be made for the second tripping means to be guided on the first tripping means.

In particular in the case of increasingly required miniaturization of drive devices and therefore also of switching device tripping apparatuses with a gear arrangement, it is necessary to position the individual assemblies ever closer to one another. If the first tripping means is now used to guide or mount the second tripping means, the number of necessary bearing elements can be reduced. For example, the first tripping means can have a groove or a cutout on which the second tripping means is supported or at which the second tripping means is guided.

Furthermore, provision can advantageously be made for the second tripping means to protrude into, in particular pass through, a cutout in the first tripping means.

The use of a cutout, for example, a bush at the first tripping means, makes it possible to allow the second tripping means to pass through the cutout, for example with a variable position. The cutout can also be used to guide the tripping means against one another, in particular to mount or support the second tripping means on the first tripping means. The second tripping means can be mounted rotatably and/or displaceably in the cutout, in particular in a bush. Thus, the first tripping means, which for its part is supported on a bearing apparatus, can be used to at least partially guide the second tripping means, with the result that a separate bearing apparatus for the second tripping means can be configured at least in simplified form or can be dispensed with entirely. For example, provision can be made for the cutout to enable a linear movement of the second tripping means, with the result that, when using two linearly displaceable tripping means, the two are guided parallel, in particular coaxially to one another. It may further be advantageous if the first tripping means is a rotationally symmetrical body and the cutout passes through the first tripping means coaxially with respect to the axis of rotation.

Advantageously, provision can be made here for the first tripping means to at least partially surround the second tripping means in hollow-cylindrical fashion.

The first tripping means can be at least sectionally hollow-cylindrical, wherein the hollow-cylindrical section of the first tripping means surrounds the second tripping means. As a result, a cutout is formed which is used, for example, to guide the second tripping means. For example, the first tripping means can be at least sectionally hollow-cylindrical, wherein the wall thickness in the hollow-cylindrical section of the first tripping means can be embodied differently. The hollow-cylindrical section can have, for example, a cross section in the form of a circular ring or a cross section which is rectangular, oval or polygonal, etc. Advantageously, the first tripping means should, in the same way as the second tripping means, be configured rotationally symmetrically.

Furthermore, provision can advantageously be made for at least one of the tripping means to be arranged as armature on a drive element in the form of a plunger coil.

A drive element is used for bringing about a movement of a tripping means. The drive element therefore converts one form of energy into movement energy. Advantageously, electrodynamic drives for converting electrical energy into mechanical energy have been set forth since they are easily controllable and actuable. The use of a plunger coil as drive element makes it possible to impress, in a direct manner, a linear movement on the tripping means in the form of an armature. The armature can be mounted linearly displaceably along an axis, for example, wherein the armature dips into the plunger coil or is movable out of the plunger coil. Restoring forces can be generated, for example, by restoring springs, the force of gravity, etc. in order to move the armature back to a rest position. During activation of the tripping means in the form of an armature, said tripping means is moved out of its rest position in order to effect a movement or tripping of the pawl. For this purpose, the armature is moved indirectly or directly against a force introduction point of the pawl. Once tripping of the pawl has taken place, a movement of the tripping means back to its rest position takes place.

BRIEF DESCRIPTION OF THE SEVERAL VIEWS OF THE DRAWING

An exemplary embodiment of the invention is shown schematically in a drawing and described in more detail below.

DESCRIPTION OF THE INVENTION

FIGS. 1, 2, 3 and 5 illustrate the illustrated variant embodiments of a switching-device tripping apparatus, in each case with various gear arrangements, by way of example. The gear arrangements are schematized and merely exemplary. The gear arrangements and elements thereof shown in the figures are mutually replaceable. In the figures, therefore, functionally identical assemblies have been provided with the same reference symbols. Furthermore, alternative variant configurations of a gear arrangement can also be used. The figures are intended, with the gear arrangements illustrated therein, to be used for simplified understanding of the effectiveness and use of a switching-device tripping apparatus.

Figure 1:
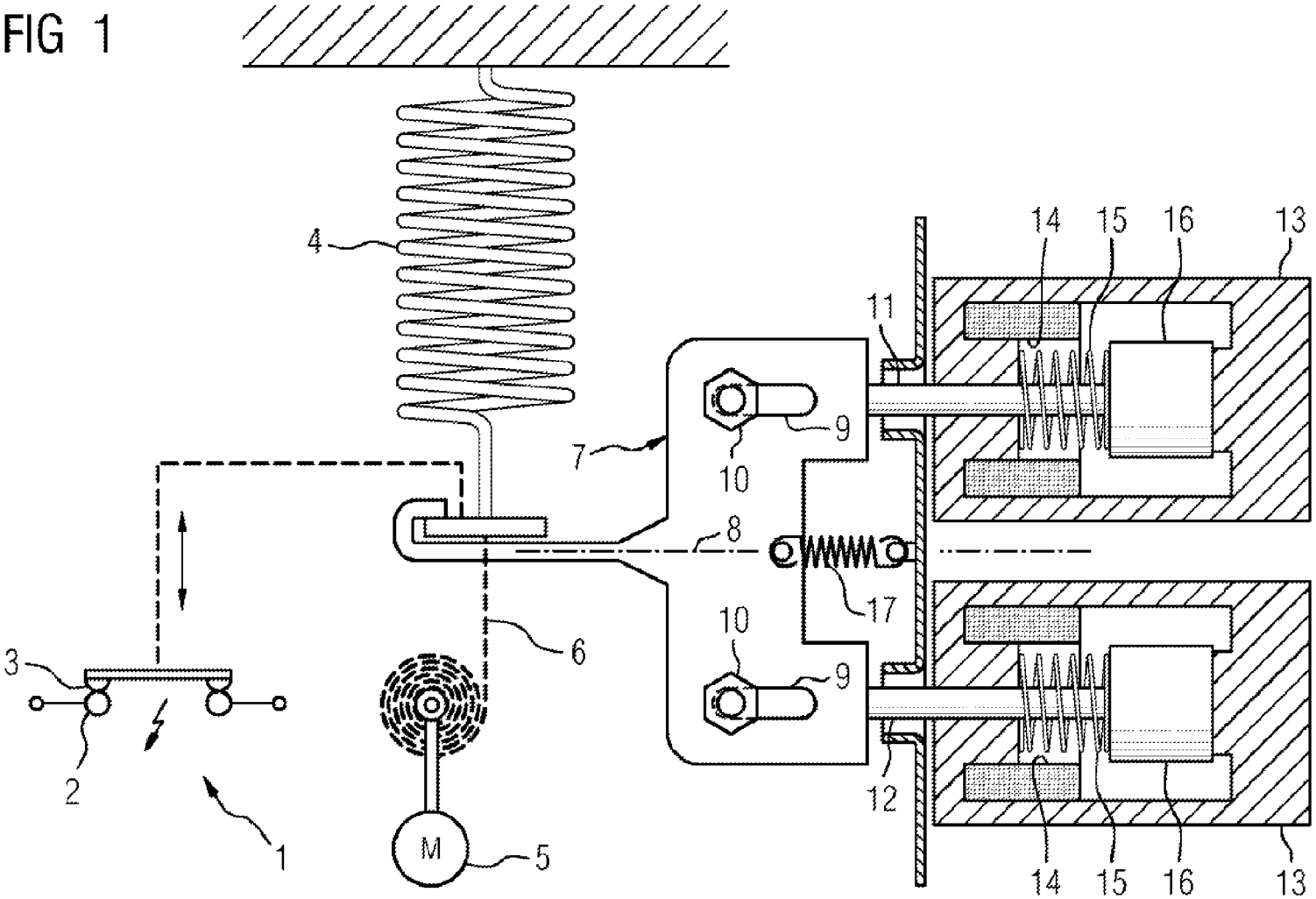
FIG. 1 shows a first variant embodiment of a switching-device tripping apparatus.

FIG. 1 shows a first variant embodiment of a switching-device tripping apparatus showing a schematic illustration of a switching device 1. The switching device 1 has a first contact piece 2 and a second contact piece 3. The first contact piece 2 is in this case arranged fixed in position. The second contact piece 3 is configured so as to be linearly displaceable, with the result that a relative movability (cf. double arrow) is provided between the first and second contact pieces 2, 3. The contact piece 3 is coupled to a storage spring 4, with the result that a switch-off movement, i.e. a separation of the two contact pieces 2, 3 from one another, takes place driven by energy which is drawn from the tensioned storage spring 4.

The storage spring 4 is part of a gear arrangement for generating the relative movement between the contact pieces 2, 3. In this case, the storage spring 4 is in the form of a helical spring which is mounted fixed in position. In order to tension the storage spring 4, an electric motor 5 is provided. The electric motor 5 is connected to the storage spring 4 via a kinematic chain 6. The kinematic chain 6 has a cable hoist, which is wound around a shaft drivable by the electric motor 5. It is thus possible to perform spring-tensioning work on the storage spring 4 by operation of the electric motor 5 and to tension the storage spring 4.

Figure 2:
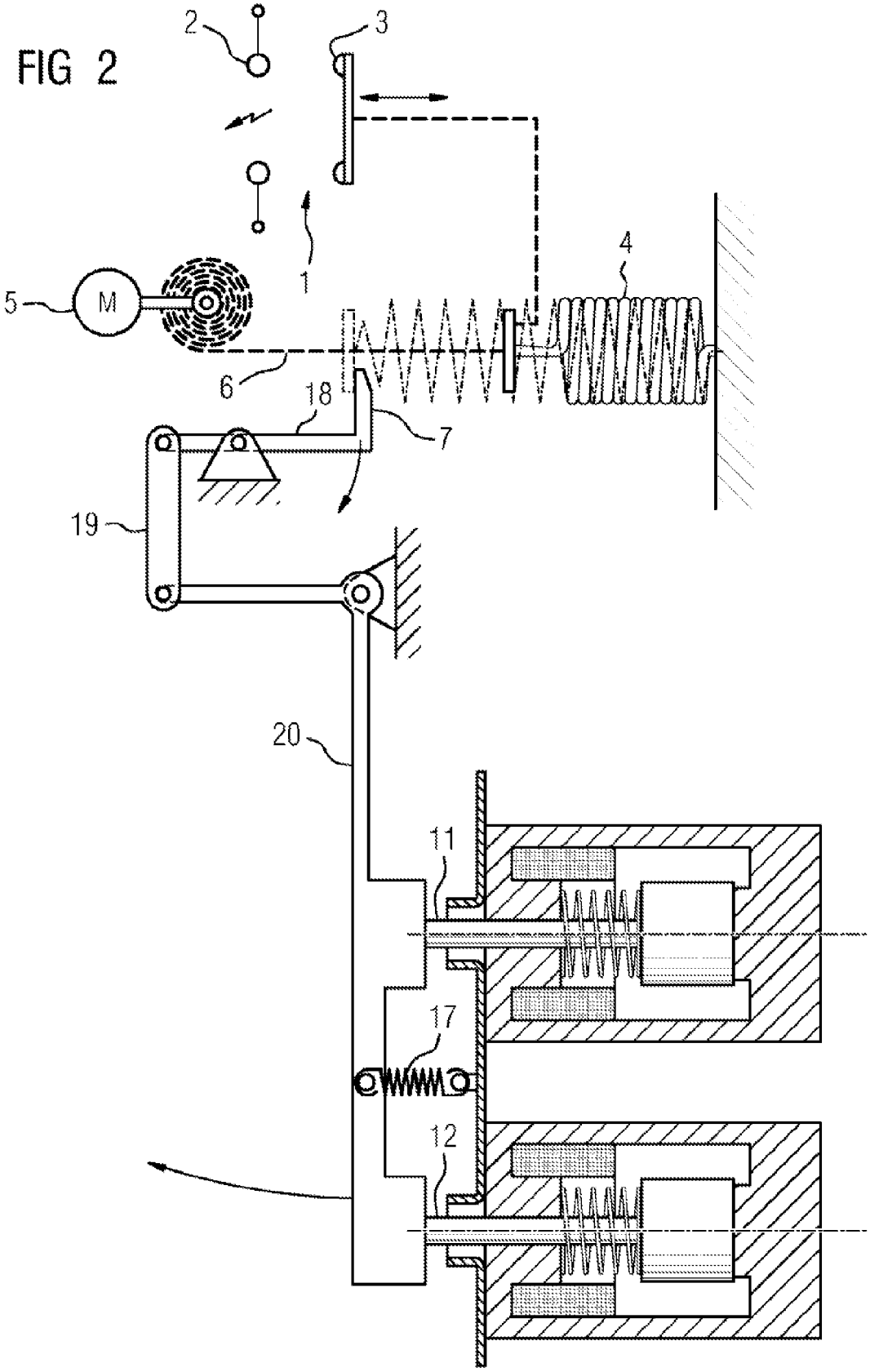
FIG. 2 shows a second variant embodiment of a switching-device tripping apparatus.
Figure 3:
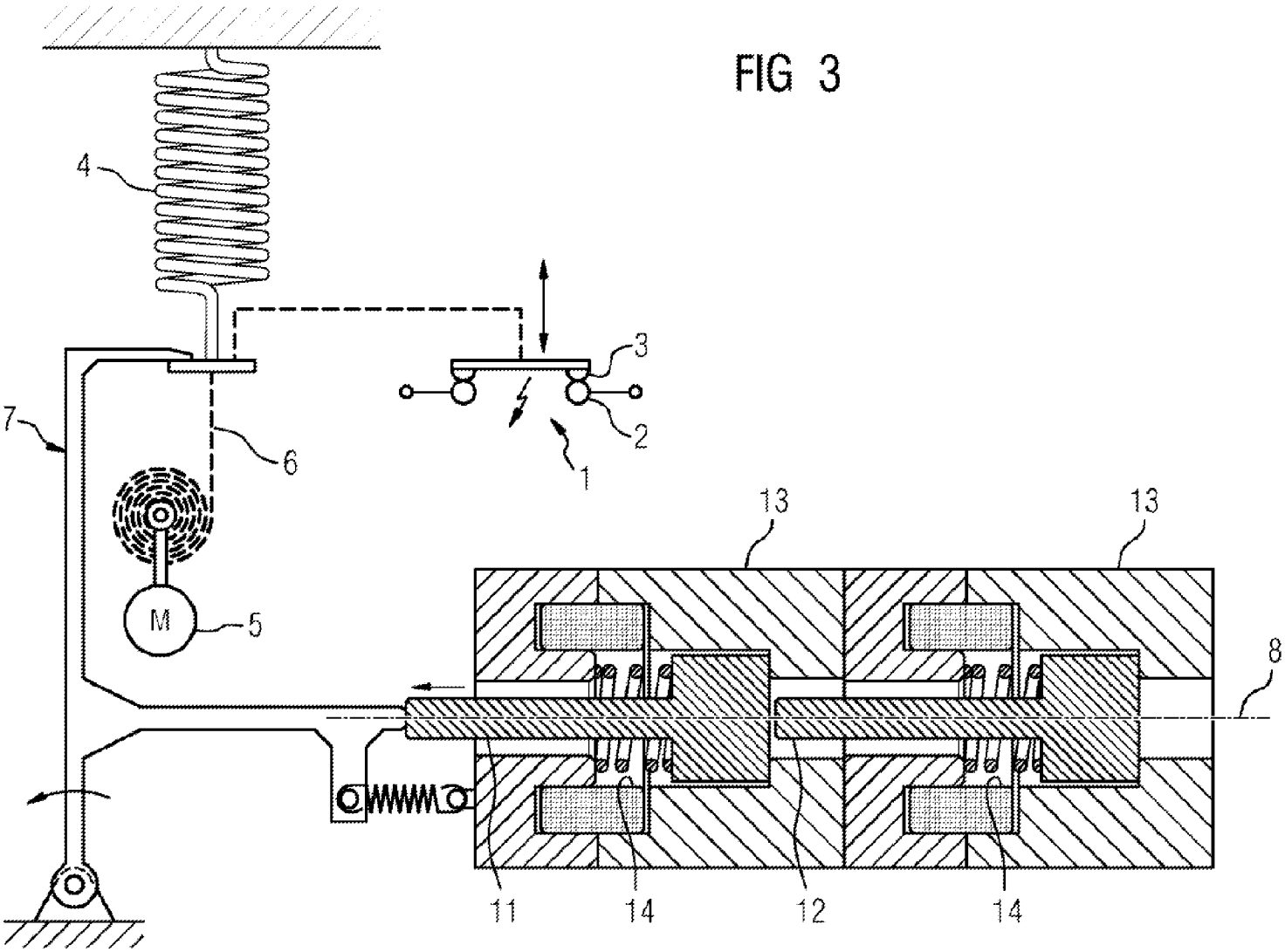
FIG. 3 shows a third variant embodiment of a switching-device tripping apparatus, FIG. 4 show parts of a fourth variant embodiment of a switching-device tripping apparatus in the unfitted state.
Figure 5:
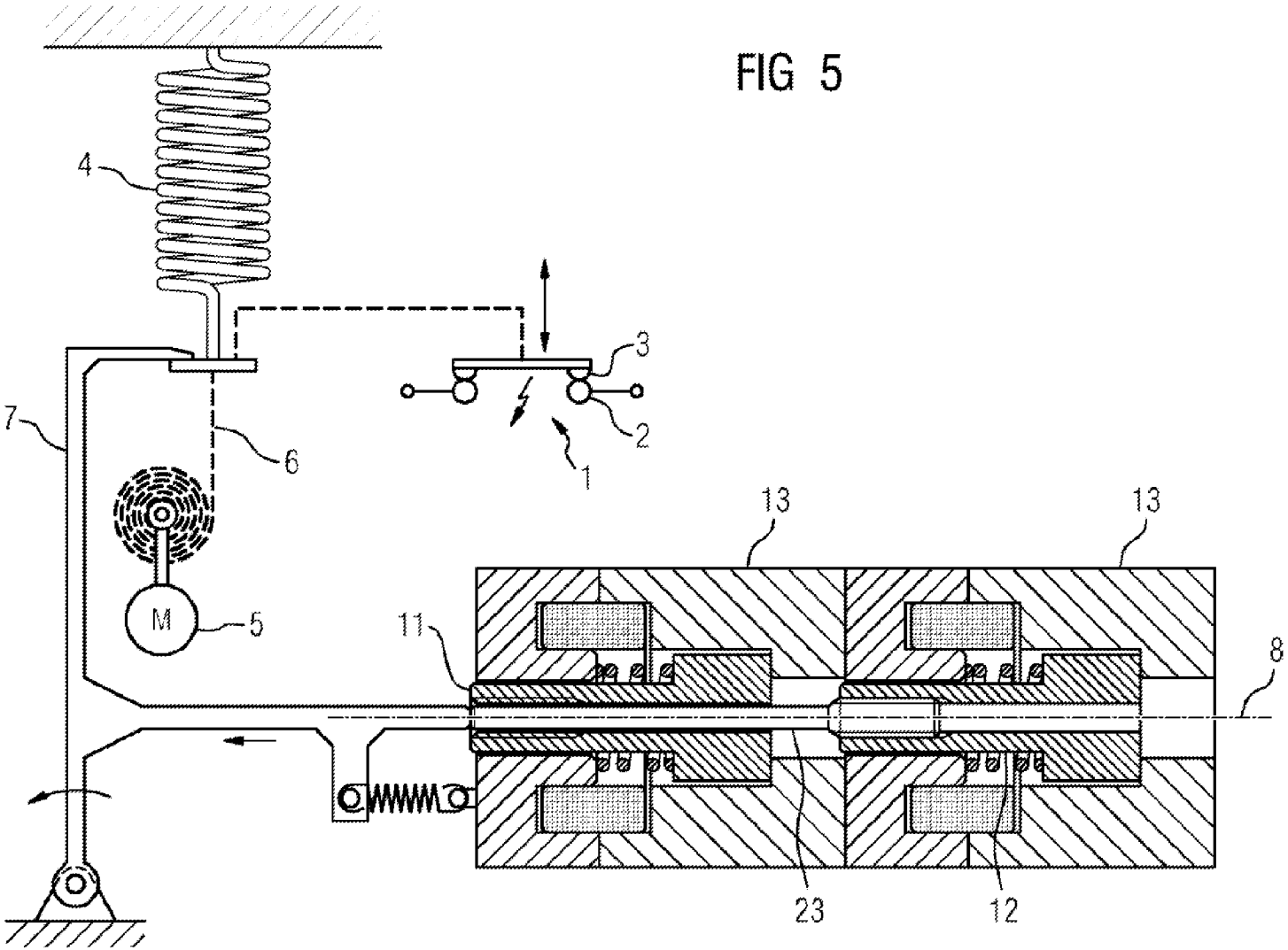
FIG. 5 shows the fourth variant embodiment, known in parts from FIG. 4, of a switching-device tripping apparatus in the fitted state.

The following description of the way in which the tripping means work and the way in which they interact with the further assemblies also relates similarly to the variant embodiments in FIGS. 2, 3 and 5. Therefore, the assemblies which have the same function are provided with the same reference symbols. In the tensioned state, the storage spring is blocked by a pawl 7, with the result that it is only possible for the storage spring 4 to be relieved of tension after actuation of the pawl 7. The pawl 7 is in the form of an integral locking bar. The storage spring 4 is relieved of tension in this case suddenly, with the result that a sudden relative movement between the two contact pieces 2, 3 takes place, in particular over the course of a switch-off operation. In order to make it possible for the tension spring 4 to be correspondingly relieved of tension suddenly, a decoupling module, for example, needs to be provided in the kinematic chain 6 to the drivable shaft, with the result that a braking effect of the kinematic chain 6 and of the electric motor 5 is prevented.

The pawl 7 is mounted linearly displaceably. Linear displaceability is possible in this case in the direction of an axis 8. For example, a displacement direction of the pawl 7 as shown in FIG. 1 is fixed by slots 9 arranged in the pawl 7 and extending in the direction of the axis 8, wherein guide bolts 10 are passed through the slots 9. The guide bolts 10 are in each case equipped with threads at the end, with the result that the guide bolts 10 can be fastened on one side to a base plate and, on the other side, at the guide bolts 10, removal of the pawl 7 is prevented by the guide bolts 10 by means of nuts which can be screwed onto the respective thread.

In order to drive the pawl 7, a first tripping means 11 and a second tripping means 12 are provided. The two tripping means 11, 12 are in the form of bolts, wherein the bolts of the tripping means 11, 12 are each guided displaceably in an iron core 13. The iron cores 13 guide the respective tripping means 11, 12 parallel to the axis 8, wherein the tripping means 11, 12 are arranged linearly displaceably parallel to the axis 8. The iron cores 13 can perform the function of a housing surrounding the tripping means 11, 12. The two tripping means 11, 12 are in this case each in the form of plunger armatures of a plunger coil 14, which acts as drive element. A plunger coil 14, with an armature, acts as an electrodynamic drive element. The respective tripping means 11, 12 act as armatures of the respective plunger coils 14. The position of the tripping means 11, 12 in the rest position is illustrated in FIG. 1. By means of in each case one restoring spring 15 arranged coaxially to the tripping means 11, 12, the two tripping means 11, 12 are each pressed away from the pawl 7 into their rest positions. Instead of the use of a restoring spring 15 for generating a restoring force, alternative apparatuses can also be used. For example, the tripping means 11, 12 can "fall back" into their rest positions as a result of the force of their weight. An abutment for the force emerging from the restoring spring 15 and stops for limit positions of the tripping means 11, 12 are provided by the respective iron core 13. The tripping means 11, 12 are each provided with a radially projecting shoulder at their end remote from the pawl 7, which shoulders each alternately rest on the stops of the limit positions of the respective iron core 13.

In the case of energization of the plunger coils 14, a magnetic force effect acts on the respective tripping means 11, 12, as a result of which the tripping means 11, 12 are moved in the direction of the pawl 7 counter to the force of the respective restoring spring 15. The tripping means 11, 12 in each case perform a linear excursion in the direction of the axis 8, hit against the pawl 7 at force introduction points and displace the pawl 7 in the direction of the axis 8. As a result, the pawl 7 releases the tensioned storage spring 4. The storage spring 4 is relieved of tension suddenly and suddenly opens the switching path between the two contact pieces 2, 3. Once the storage spring 4 has been released, the energization of the plunger coils 14 ends. The two tripping means 11, 12 are moved back into their rest positions by the force of the respective restoring spring 15. Furthermore, a return movement of the pawl 7 is also effected by a pawl restoring spring 17, with the result that the pawl 7 is again ready to secure the tensioned storage spring 4, once the storage spring 4 has been tensioned, in order to release said storage spring 4, after tripping by the tripping means 11, 12, and to generate a switching movement or relative movement between the contact pieces 2, 3.

The first tripping means 11 and the second tripping means 12 each have drive elements in the form of plunger coils 14 which act independently of one another, with the result that, in the event of failure of one of the plunger coils 14 or in the event of blocking of one of the tripping means 11, 12, the respective other undisrupted tripping means 11, 12 or the undisrupted plunger coil 14 can perform actuation of the pawl 7. The two tripping means 11, 12 act independently of one another on the same pawl 7.

FIG. 2 shows the switching-device tripping apparatus known from FIG. 1, wherein the configuration of the pawl varies. Again the use of a storage spring 4 is provided which can be tensioned by means of an electric motor 5 via a kinematic chain 6, wherein blocking of the tensioned storage spring 4 by means of a pawl 7 is provided. FIG. 2 illustrates the untensioned position of the storage spring 4, wherein the contact pieces 2, 3 are illustrated in the open position. A stretched position of the storage spring 4 in the tensioned state is indicated by dash-dotted lines on the storage spring 4, wherein the pawl 7 blocks the storage spring 4 in the tensioned state. In the text which follows, details will only be given of the alternative configuration of a pawl 7. The pawl 7 has in this case a two-armed lever 18 which is mounted fixed in position. The fixed lever 18 is pivotable about a fixed fulcrum with the result that the pawl 7 can release a tensioned storage spring 4. A connecting rod 19 is connected to one arm of the fixed lever 18. The connecting rod 19 connects the fixed lever 18 to an elbow lever 20. The elbow lever 20 is mounted fixed in position, wherein the elbow lever 20 is movable by a first and a second tripping means 11, 12. Force introduction points of the two tripping means 11, 12 are located at the elbow lever 20 of the pawl 7. Owing to a movement of the tripping means 11, 12, a movement of the pawl 7 is effected which, analogously to the variant embodiment described in FIG. 1, causes a tensioned storage spring 4 to be relieved of tension. The assemblies required for moving the tripping means 11, 12 are embodied analogously to the assemblies in FIG. 1 and are consequently provided with the same reference symbols. In contrast to FIG. 1, the pawl 7 is in the form of a lever chain.

In FIGS. 3 and 5, basic illustrations each show a latching mechanism and the gear arrangement. Functionally identical assemblies are provided with the same reference symbols as in FIGS. 1 and 2. Since the operation is analogous to that in FIGS. 1 and 2, only the way in which tripping means and drive means are configured are described in more detail in relation to FIGS. 3, 4 and 5.

FIG. 3 illustrates a force introduction point of two tripping means 11, 12 at a pawl 7. The pawl 7 is pivotable about a fixed bearing point. A first tripping means 11 and a second tripping means 12 are arranged axially one behind the other, wherein the two tripping means 11, 12 are each configured in the form of bolts. In this case, provision is made for the second tripping means 12 to be movable against the pawl 7, with the first tripping means 11 interposed, in order to pivot the pawl 7. Correspondingly, provision is made for the tripping means 11, 12, in each case in the form of plungers, to be arranged one behind the other in such a way that the plunger of the second tripping means 12, as it moves from its rest position into a tripping position, is driven against the first tripping means 11 and therefore, in the event of failure the plunger coil 14 of the first tripping means, for example, actuates the pawl 7, with the first tripping means 11 interposed. Correspondingly, provision is made for a cutout formed coaxially to the axis 8 to be provided in the iron core 13 of the first tripping means 11, through which cutout the second tripping means 12 can protrude into the interior of the iron core 13 of the first tripping means 11, with the result that a force can be exerted by the second tripping means 12 onto the first tripping means 11. If both tripping means 11, 12 are set in motion by the plunger coils 14, the forces emerging from the two tripping coils 11, 12 are added for activation of the pawl 7. The force effect which can be generated by one of the plunger coils 14 is in this case dimensioned, however, such that, even in the event of failure of one of the plunger coils 14, a force effect which is sufficient for activating the pawl 7 can be brought about by a single plunger coil 14. Even in the event of failure of the plunger coil 14 of the first tripping means 11, a force effect on the second tripping means 12 is produced and a displacement of the first tripping means 11 in the direction of the axis 8 against the pawl 7 is produced. The second tripping means 12 moves the first tripping means 11 in the direction of the axis 8 against the pawl 7 and, with the first tripping means 11 interposed, effects activation of the pawl 7 by the second tripping means 12. In the reverse case, in the event of failure of the plunger coil 14 of the second tripping means 12, the second tripping means 12 remains at rest and only the first tripping means 11 moves the pawl 7. The two tripping means 11, 12 act on the pawl 7 at the same force introduction point (indirectly or directly).

A modular design of tripping means and plunger coils and iron cores will be described in more detail below with reference to FIGS. 4 and 5.

Figure 4:
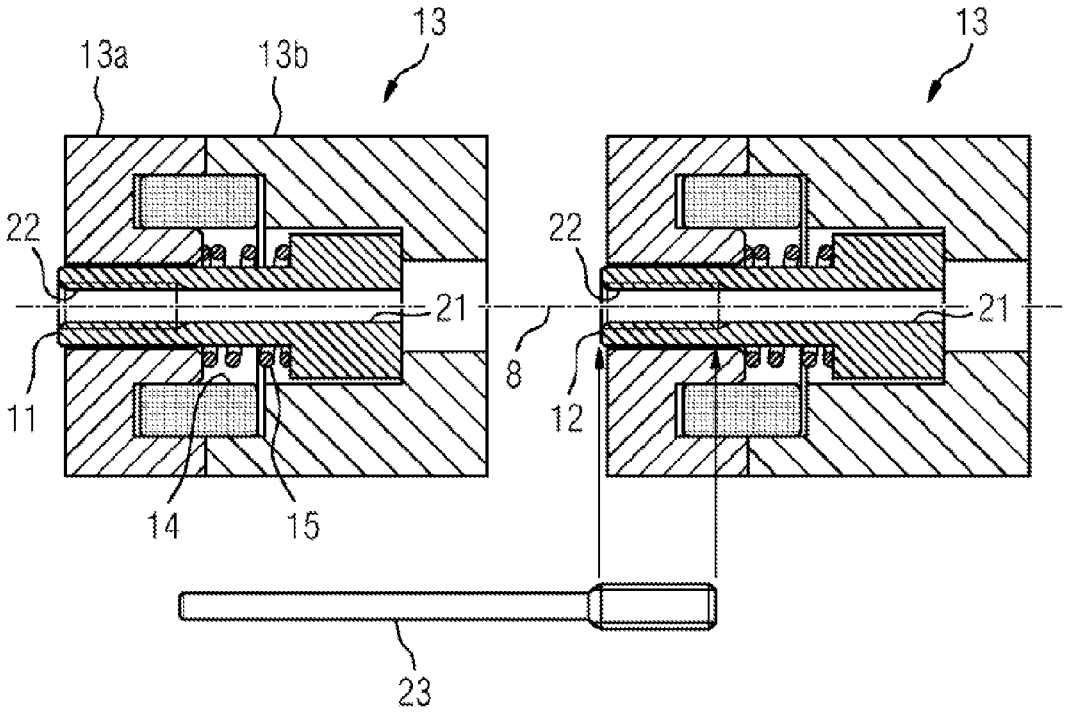

FIG. 4 shows the design of the iron cores 13 of a first and a second tripping means 11, 12. The iron cores 13 and the drive means for the first and second tripping means 11, 12 each have an identical design. Therefore, the design of iron core 13 and drive means 14 of the first tripping means 11 will be described by way of example below with reference to FIG. 4, for example. The iron core 13 is arranged rotationally symmetrically with respect to a longitudinal axis 8 and has a first subelement 13*a* and a second subelement 13*b*. The two subelements 13*a*, 13*b* make contact with one another on mutually facing end sides, wherein the end sides are aligned perpendicular to the axis 8. Cutouts running peripherally in the form of a ring are introduced into the mutually facing end sides, which cutouts are used for receiving a plunger coil 14 located between the two subelements 13*a*, 13*b* of the iron core 13. The plunger coil 14 is thus embedded in the iron core 13 and aligned coaxially to the axis 8. The iron core 13, in particular its first subelement 13*a*, is used for directing a magnetic field which can be generated by the plunger coil 14.

A continuous cutout passes centrally through the iron core 13 in the direction of the axis 8, which cutout has substantially cylindrical inner lateral surfaces, wherein a plurality of projecting shoulders are provided for forming stops for the first tripping means 11. The first tripping means 11 is in this case in the form of a hollow cylinder, which is mounted in sliding fashion in the first subelement 13*a* of the iron core 13. Thus, the first tripping means 11 can be displaced in the direction of the axis 8. At its end lying within the iron core 13, the first tripping means 11 is radially extended, with the result that projecting shoulders are formed which rest on mirror-inverted stops of the iron core 13 in the end positions, for example in a rest position. The radial extension of the first tripping means 11 is hollow-cylindrical, wherein an outer lateral surface of the radial extension is guided in sliding fashion in a mirror-inverted inner lateral surface of the second subelement 13*b* of the iron core 13. By virtue of the radial extension, the free movability of the first tripping means 11 in the direction of the axis 8 is limited at the first tripping element 11. Thus, firstly a rest position of the first tripping means 11 in the iron core 13 can be assumed, wherein the first tripping means 11 is drawn virtually completely into the iron core 13 in the rest position of said first tripping means. In order to retain the first tripping means 11 safely in its rest position, a restoring spring 15 is provided which presses the radial extension of the first tripping means 11, supported on the first subelement 13*a* of the iron core 13, against a projecting shoulder of the second subelement 13*b* of the iron core 13. It is thus possible, in the case of energization of the plunger coil 14, for the first tripping means 11 to dip into the plunger coil 14, in the manner of a plunger armature, counter to the force of the restoring spring 15, wherein the first tripping means 11 emerges at the end out of the iron core 13 and, once energization of the plunger coil 14 has ended, a return movement of the first tripping means 11 into its rest position takes place owing to the restoring force of the tensioned restoring spring 15. As already mentioned in respect of FIG. 1, it is possible to dispense with a restoring spring or to use an alternative apparatus.

The first tripping means 11 is provided with a cutout 21, which extends coaxially to the axis 8 and passes completely through the first tripping means 11. At its end remote from the radial extension, the first tripping means 11 is provided with an internal thread 22. Owing to the cutout 21, the first tripping means 11 is configured in the form of a bush, with the result that the bush can be used, for example, for guiding or mounting a second tripping means 12, for example.

The second tripping means 12 has a basic body, which corresponds in terms of its construction to the first tripping means 11. A bar 23 is screwed into an internal thread 22 of the cutout 21 of the basic body of the second tripping means 12, which bar completes the second tripping means 12. The bar 23 is in this case likewise, in the same way as the basic body of the second tripping means 12, aligned coaxially to the axis 8. The bar 23 has such a cross section that it can be inserted into the cutout 21 in the first tripping means 11 in the manner of a clearance fit, with the result that the bar 23 is mounted displaceably in the cutout 21 in the first tripping means. Thus, a bearing bush is provided on the first tripping means 11 for the second tripping means 12.

Therefore, a first and a second tripping means 11, 12 are formed which each output a linear movement and each act on the same pawl or drive the same pawl, wherein the two tripping means 11, 12 are aligned coaxially to one another, i.e. the first tripping means 11 surrounds the second tripping means 12 at least sectionally on the outer lateral surface side, wherein each of the two tripping means 11, 12 is drivable via a separate drive device.

FIG. 5 shows the arrangement known from FIG. 4 comprising bar 23, which passes through the bush of the first tripping means 11. The two iron cores 13 of the two tripping means abut one another flush in the direction of the axis 8 and are aligned with one another. The bar 23 or the second tripping means 12 is mounted on the first tripping means 11 via the bar 23 of the second tripping means 12. The two tripping means 11, 12 face the pawl 7 at an end side of one of the iron cores 13, in this case the iron core 13 of the first tripping means 11, wherein each of the tripping means 11, 12 can act directly on the pawl 7. The possibility is thus provided of both the first tripping means 11 and the second tripping means 12 being able to effect a movement of the pawl 7 independently of the state of the respective other tripping means or the plunger coils, restoring springs etc. thereof. The first and second tripping means 11, 12 act on the pawl 7 at virtually the same force introduction point on said pawl 7. Thus, tilting and tipping can be avoided, and the pawl 7 can perform a pivoting movement.

The invention claimed is:

1. A switching device tripping apparatus for a switching device, the switching device tripping apparatus comprising:

contact pieces configured to move relative to one another;

a gear configuration configured to generate a relative movement between said contact pieces, said gear configuration having a pawl;

first and second tripping devices having plungers configured to independently move against, actuate and drive said pawl;

a bar having one end connected to said second tripping device and another end passing through said first tripping device for driving said pawl; and first and second drive apparatuses each configured to independently exert a force effect on a respective one of said first and second tripping devices.

2. The switching device tripping apparatus according to claim 1, wherein said tripping devices are each mounted to be linearly displaceable.

3. The switching device tripping apparatus according to claim 1, wherein said second tripping device is configured to move against said pawl with said first tripping device interposed between said second tripping device and said pawl.

4. The switching device tripping apparatus according to claim 1, wherein said movement axes of said first and second tripping devices are coaxial.

5. The switching device tripping apparatus according to claim 1, wherein said second tripping device is guided on said first tripping device.

6. The switching device tripping apparatus according to claim 1, wherein said second tripping device protrudes into a cutout formed in said first tripping device.

7. The switching device tripping apparatus according to claim 6, wherein said second tripping device passes through said cutout formed in said first tripping device.

8. The switching device tripping apparatus according to claim 1, wherein said first tripping device has a hollow cylindrical structure at least partially engaging around said second tripping device.

9. The switching device tripping apparatus according to claim 1, which further comprises at least one drive element constructed as a plunger coil, at least one of said tripping devices being disposed as an armature at said at least one drive element.

10. The switching device tripping apparatus according to claim 1, wherein said gear configuration includes a storage spring, and said pawl is configured to block movement of said storage spring in a tensioned state of said storage spring and to relieve tension in said storage spring when actuated by at least one of said first and second tripping devices.

11. The switching device tripping apparatus according to claim 1, wherein said first tripping device directly drives said pawl.

12. The switching device tripping apparatus according to claim 1, wherein said first and second tripping devices are identically constructed.

* * * * *